US006434857B1

(12) United States Patent
Anderson et al.

(10) Patent No.: US 6,434,857 B1
(45) Date of Patent: Aug. 20, 2002

(54) COMBINATION CLOSED-CIRCUIT WASHER AND DRIER

(75) Inventors: Robert David Anderson, Wichita Falls; Matthew David Anderson, Houston, both of TX (US)

(73) Assignee: SmartClean JV, Wichita Falls, TX (US)

( * ) Notice: Subject to any disclaimer, the term of this patent is extended or adjusted under 35 U.S.C. 154(b) by 0 days.

(21) Appl. No.: 09/610,035

(22) Filed: Jul. 5, 2000

(51) Int. Cl.[7] ..... F26B 11/02

(52) U.S. Cl. ..... 34/595; 34/74; 34/75; 34/77; 34/80; 34/128; 34/473; 68/13; 68/19; 68/20

(58) Field of Search ..... 34/74, 75, 76, 34/77, 80, 128, 131, 596, 595, 598, 473; 68/13, 19, 20

(56) References Cited

U.S. PATENT DOCUMENTS

| | | | | | |
|---|---|---|---|---|---|
| 3,034,221 | A | * | 5/1962 | Tuck et al. | 34/527 |
| 3,387,385 | A | * | 6/1968 | Mandarino, Jr. et al. | 34/596 |
| 4,023,940 | A | | 5/1977 | Schultz | 55/163 |
| 4,112,590 | A | | 9/1978 | Muller | 34/75 |
| 4,125,946 | A | * | 11/1978 | Prager | 34/80 |
| 4,204,339 | A | | 5/1980 | Muller | 34/75 |
| 4,581,047 | A | | 4/1986 | Larsson | 55/179 |
| 4,756,726 | A | | 7/1988 | Peace | 55/275 |
| 4,765,162 | A | | 8/1988 | Ouellette | 68/20 |
| 4,805,317 | A | | 2/1989 | Inglis et al. | 34/1 |
| 4,887,438 | A | | 12/1989 | Meckler | 62/271 |
| 5,058,401 | A | | 10/1991 | Nakamura et al. | 68/19.2 |
| 5,146,693 | A | | 9/1992 | Dottor et al. | 34/77 |
| 5,343,632 | A | * | 9/1994 | Dihn | 34/507 |
| 5,347,610 | A | * | 9/1994 | Lee | 392/447 |
| 5,373,704 | A | | 12/1994 | McFadden | 62/94 |
| 5,628,122 | A | | 5/1997 | Spinardi | 34/79 |
| 5,689,893 | A | | 11/1997 | Mitsch | 34/80 |
| 5,832,750 | A | | 11/1998 | Yamamoto | 68/13 |
| 6,094,835 | A | * | 8/2000 | Cromer | 34/80 |
| 6,161,306 | A | * | 12/2000 | Clodic | 34/321 |

OTHER PUBLICATIONS

Pamphlet, Equator Corporation, 1998 Fifth Addition.

* cited by examiner

*Primary Examiner*—William C. Doerrler
*Assistant Examiner*—Mark Shulman
(74) *Attorney, Agent, or Firm*—Bracewell & Patterson, LLP

(57) ABSTRACT

A combination closed-circuit washer and drier apparatus having a washing cycle and a drying cycle. The apparatus comprises a unitary housing having a tub and a tumbler within the tub, the tub also having an air inlet and air outlet which allows air to flow through the tub, wherein air flowing from the air inlet is in communication with the tumbler. The apparatus also includes a desiccant recharging system located within the unitary housing having a entrance and an exit, the entrance coupled to the air outlet and the exit coupled to the air entrance, thus allowing a continuous flow of air through the system. The desiccant recharging system also includes a diverting valve that directs the flow of air primarily through the desiccant system in a closed-loop during the wash cycle. The diverting valve alters the air flow between the washing cycle (desiccant regeneration) to the drying cycle (desiccant water adsorption).

12 Claims, 3 Drawing Sheets

COMBINATION CLOSED-CIRCUIT WASHER AND DRIER

BACKGROUND OF THE INVENTION

1. Field of the Invention

The present invention relates to a combination clothing washer and drier apparatus. More specifically, the present invention relates to a clothing drier that incorporates the use of solid phase desiccants such as molecular sieves or silica gel to remove water from the drying air, the drying air being recirculated through the apparatus.

2. Description of the Prior Art

Clothing washers and driers are well known in the art. Given the desire to save space, there is increasing interest in combination washer and drier systems, wherein a single rotating drum is utilized for both the washing of clothing and drying of the clothing in one unit. However, since most prior art clothing driers pull surrounding air into the drier that is then heated, passed over the wet clothing where water is transferred to the hot air, and the air then vented to the outside, an external air vent is thus required. This method not only requires a vent pipe to the outside, it requires air to be flowing into the building or dwelling containing the drier. This requires continuous cooling or heating of the replacement air by the air conditioner or heater in the building. This extra air cooling or heating is expensive. Further, the drying time and efficiency is limited by the amount of external air that can be pulled into the drier.

Convenience for household use is gained by replacing the entire washer and drier system into a ventless system that uses the same volume of air in the entire drying process. This is typically accomplished in one combination washer/drier unit, such as that marketed by EQUATOR Corporation (Houston, Tex.). The lint taken up from the drying clothing is absorbed by a spray of water through the heated air coming from the clothing, thus trapping the lint in the cooling water and then discharging the water from the unit. However, the problem with this ventless system is that the drying time is impractically long—from two to three hours. This is because the mister only removes some of the moisture in the hot air by condensation, but still leaves some of the moisture in the air only to be heated and passed back over the clothing to be dried. And, while increasing the air flow may improve the drying time, this also necessitates an increase in the misting to the point of being impractical to achieve the desired drying time because of the large amount of misting water required.

It is desirable in a ventless washer-drier system to have an alternative method of drying the heated, moisture laden air from the clothing that does not rely entirely on the mister sprayer. Desiccants, and in particular, solid desiccants such as molecular sieves, are one alternative. Solid desiccants such as 3A, 4A, and 5A molecular sieves and silica gel can selectively adhere water molecules to the surfaces and interiors of the lattice structure. These desiccants have been used to dry air in applications such as in Larsson (U.S. Pat. No. 4,581,047), who discloses a method of using a solid desiccant in a compressed air line to dry the air, the desiccant being in the form of a cartridge that is replaced once the desiccant has reached adsorptive capacity. However, it is desirable to regenerate the desiccant and thus re-use the same desiccant many times, especially in residential washer and drier units. Reversible removal of the adsorbed water is necessary to make the use of solid desiccants practical in a washer-drier system that is to be used repeatedly in an economical manner. This is typically accomplished by passing relatively dry air over the desiccant while heating the desiccant, as, for instance, is disclosed by Shultz (U.S. Pat. No. 4,023,940).

There are several other methods of regenerating or "charging" solid desiccants. A simple, rechargeable silica gel solid desiccant is disclosed by Peace in U.S. Pat. No. 4,756,726. Another is disclosed by Inglis et al. (U.S. Pat. No. 4,805,317), which uses microwave irradiation of the sieves to drive the water off. Meckler (U.S. Pat. No. 4,887,438) discloses a desiccant assisted air conditioner that uses hot air from the cooling condenser to heat and charge the desiccant. Finally, McFadden (U.S. Pat. No. 5,373,704) uses desiccants in a dehumidifier for home use, the desiccant being regenerated by regenerative air heated by such means as an electric heating coil or natural gas. All of these prior art methods employ the use of air or heated air passed over the moist desiccant that is supplied by external air.

A combination washer-dryer that uses the same volume of air to dry clothing (hence, ventless) through the use of solid desiccants has not been disclosed. There is a need for a practical to use washer and drier combination that has no vent, thus allowing more convenient use in apartment or condominium dwellings. Further, there is a need for a combination washer-drier that operates efficiently and has a reasonably short drying time for the clothing. The present invention is directed towards such use.

SUMMARY OF THE INVENTION

It is therefore one object of the present invention to provide a combination washer and drier apparatus for washing clothing and other water-washable articles.

It is another object of the present invention to provide a combination washer-drier apparatus that is made ventless by utilizing the same or substantially the same volume of air during the drying cycle.

It is yet another object of the present invention to provide a solid desiccant clothes drying system that can be re-used by being dehumidified during the wash cycle of the apparatus.

These and other objects of the present invention are achieved by providing a combination closed-circuit washer and drier apparatus having a washing cycle and a drying cycle. The apparatus comprises a unitary housing having a tub and a tumbler within the tub, the tub also having an air inlet and air outlet which allows air to flow through the tub, wherein air flowing from the air inlet is in communication with the tumbler. The apparatus also includes a desiccant charging system located within the unitary housing having a entrance and an exit, the entrance coupled to the air outlet and the exit coupled to the air entrance, thus allowing a continuous flow of air through the system. The desiccant charging system also includes a diverting valve that directs the flow of air primarily through the desiccant system in a closed-loop during the wash cycle. The diverting valve alters the air flow between the washing cycle (desiccant regeneration) to the drying cycle (desiccant water adsorption).

The desiccant charging system has a solid desiccant packed within a desiccant housing, typically molecular sieves of a pore diameter of between about 3 and 5 Angstroms. The desiccant housing typically has a thickness that is at least twice as long as the length to increase the adsorption efficiency. Further, the desiccant charging system includes a dehumidification means, wherein the dehumidification means can be a heating coil, a vacuum apparatus, a microwave generator, or any combination of these. In yet a third embodiment, the desiccant charging system has a water mist spray apparatus to facilitate the removal of water from the air flow during the washing and drying cycles.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
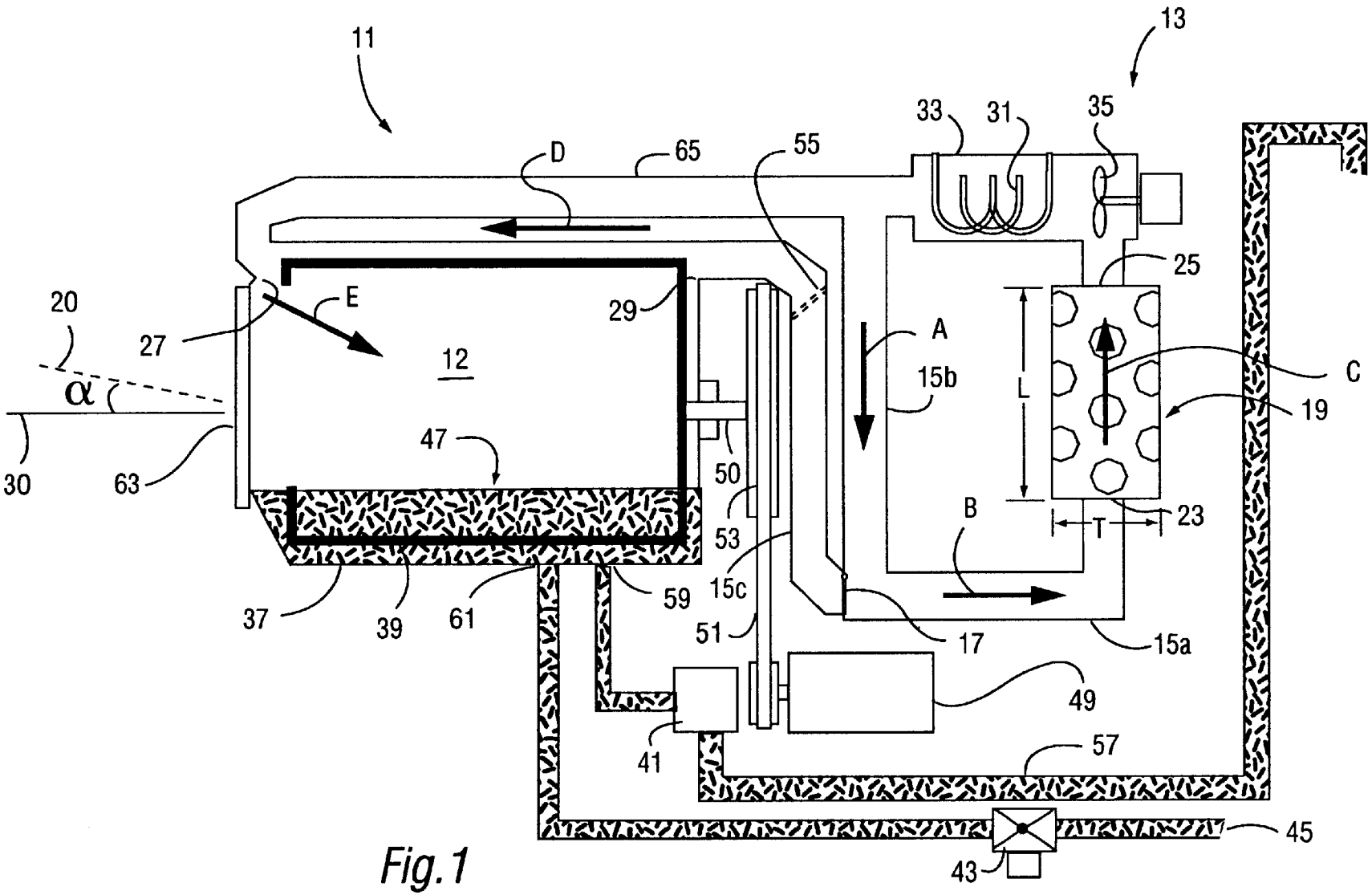
FIG. 1 is a schematic view of the washing cycle of the combination washer-drier of the invention.

The present invention is a combination closed-circuit washer and drier apparatus having a washing cycle and a drying cycle. The apparatus is preferably used to wash and dry clothing and other water-washable articles in a unitary washer-drier that uses the same or substantially the same volume of air to dry the clothing throughout the washing and drying process. Thus, little or no air is drawn from the surroundings of the apparatus once it is closed. The apparatus is designed to use traditional washing detergents in the washing cycle, and have various washing cycles that are operated by mechanical and/or electronic timing devices known in the art. For example, there may be a regular wash cycle and a delicate wash cycle, each cycle having washing and rinsing cycles therein.

The combination washer-drier apparatus includes a tub and tumbler made from such materials as stainless steel to house the clothing to be washed and water within the tub. The tub and tumbler therein is part of a washing cycle air pathway and a drying cycle air pathway, each pathway allowing the same volume of air to flow there through. Thus, once clothing is placed within the tub, a doorway seals the tub and all air pathways to create a volume of air within the apparatus tub and air pathways that is then circulated to dry the clothing.

The washing cycle air pathway includes a desiccant charging system and the drying cycle air pathway comprises the tub having a tumbler therein also in air-flow communication with the desiccant charging system. A diverting valve diverts the flow of air from the drying cycle air pathway to the washing cycle air pathway during the washing cycle in order to dehydrate the air passing there through. The air is then re-diverted to facilitate the drying cycle. During both cycles, the air passes through a desiccant which is part of the desiccant recharging system. The air flow through the desiccant serves two purposes, depending upon the cycle the apparatus is operating in: first to dehumidify the desiccant during the washing cycle (or "recharging" the desiccant), and second to dry the moisture laden air from the drying clothing during the drying cycle.

Thus, the desiccant recharging system removes moisture from the air used in drying the clothing during the drying cycle, the solid desiccant thus adsorbing the moisture from the air. The desiccant recharging system then removes the adsorbed water from the desiccant. In this manner, the desiccant recharging system is regenerated during the washing cycle. This is a reversible process that can preferably be carried out for between 10 to 20 years, depending upon the type of desiccant used.

Preferably, the desiccant recharging system utilizes a solid desiccant. The preferred desiccant is silica gel-$H_2SiO_3$. The silica gel used in the present invention are particles in the size range of between about 2–10 mm crushed rock. Silica gel is commercially available from various vendors, and its use as a regenerable dehumidifier is disclosed in U.S. Pat. No. 4,756,726. Other materials such as $CaSO_4$ and clay materials can serve as the solid desiccant. Other desiccants can also be used such as a molecular sieve zeolite material that is commercially available from such sources as ZEOCHEM (Louisville, Ky.) The preferred type of molecular sieve is a Type A sieve which is structured as a series of tetrahedra grouped to form truncated octahedrons having a pore size of about 4.2 Angstroms that opens up to a cavity of about 11.5 Angstroms in diameter. Typically, sieves that are used in the present invention are termed 3A, 4A or 5A, (3–5 Angstroms pore diameters) depending upon the structure and hence, pore sizes. The sieves are typically beads of between about 1 and 4 mm diameter, and are highly efficient in absorbing water.

While solid desiccants will absorb moisture when used as an open bed, it is more practical and efficient to place the sieves in a housing having an air entrance and an air exit. The placement of the entrance and exits, and the geometry of the housing, can be adjusted to alter the efficiency of the water absorption process and the pressure drop created in the housing between the entrance and exit when molecular sieves are present. For example, when the bed diameter (or thickness) is at least ¼ of the bed length and the housing is filled with sieves or crushed silica gel, a relatively high water capacity of 10% by weight is achieved. However, this is at the expense of having a high pressure drop. Making the ratio of bed thickness to bed length closer to unity lowers the pressure drop, but also lowers the water capacity. In the present invention, it is preferable that the desiccant housing have a thickness that is at least twice as long as the length, thus improving the airflow required for efficient drying of the clothing. It is ideal to utilize the air circulating fan in conjunction with the desiccant to create a large amount of air turbulence within the desiccant housing, as this increases the efficiency of desiccant regeneration.

The desiccant recharging system also has heating coils to heat the air therein for use in drying the clothing during the drying cycle, and in heating the air within the apparatus air pathways during the washing cycle in order to facilitate the dehumidification of the desiccant. For a relatively small, compact unit, the heating coils can be either 110 volt unit or a 220 volt unit. The 110 volt unit, for example, may be an 11 Amp unit of 1200 watt power. For faster drying and desiccant regeneration times, a 220 volt unit of 11 Amps can be used having a power of 2400 watts. At least one fan is used to circulate air through the air pathways. Preferably, the fan should be able to circulate at a rate of at least 150 cfm, and preferably 250 cfm (typically 1.5 Amp) for a smaller washer-drier unit. For a larger washer-drier apparatus, a fan that can circulate at a rate of 400–500 cfm (typically 3–5 Amp, or 4500 watts power) is preferable. The more air that can be circulated through the air pathways, the faster the drying and regeneration times become.

To increase the efficiency of the closed-system washer-drier, several other design features are present. The tub is placed in the housing at an angle of between about 0° to 30° relative to the flat surface (horizon) upon which the apparatus is placed, the tumbler being at an angle equal to that of the tub. This horizontal or near horizontal placement of the axis of rotation of the tumbler improves the drying efficiency of the apparatus. The tub may also be insulated in one embodiment of the invention to help hold heat within the compartment and thus improve the drying efficiency. Further, the tumbler is programmed in the present invention to turn continuously in one direction during the drying cycle, contrary to its action in the washing cycle. Finally, in another embodiment of the invention, the desiccant recharging system may incorporate a water mist spray apparatus to facilitate the removal of water from the air flow during the washing and drying cycles.

The invention is further described with respect to the figures, wherein FIG. 1 is a schematic diagram of the washing cycle, and hence first cycle, of the combination washer-drier apparatus 11. The apparatus 11 comprises two closed air flow pathways, one air flow pathway primarily operational during the washing cycle and the other pathway primarily operational during the drying cycle. Substantially or all of the same volume of air is used throughout the washing and drying process of one load of laundry. By use of the phrase "substantially all of the same volume of air", it is understood that the air flow system and tub door may not be completely free of air leakage. Thus, a small amount of air from the surroundings could leak into the system, or be released from the apparatus.

The washing cycle air pathway primarily takes place in the desiccant recharging system 13. The recharging system includes a desiccant 21 housed in a desiccant housing 19. The housing has an entrance 23 and an exit 25 to which conduits can be connected, and through which air can flow. The air flow is described in more detail below. The recharging system 13 also includes a dehumidifying means 33. In a preferred embodiment, the dehumidifying means is a set of heating coils 31. The coils may be powered by a 110 volt power source, but preferably a 220 volt power source. The dehumidifying means may also be a microwave generating apparatus such as disclosed in U.S. Pat. No. 4,805,317, herein incorporated by reference. In either embodiment, a set of heating coils 31 is necessary to heat the air for the drying cycle. The microwave generating apparatus may be used to help dehumidify the desiccant 19. In yet another embodiment, the dehumidifying means is a vacuum pump that will lower the air pressure above the desiccant bed within the housing while it is being heated, thus drawing the desorbed water from the bed.

The desiccant housing 19 has a geometry to maximize the air flow through the desiccant bed, and minimize the pressure drop. A preferred geometry is for the length L to be less than or equal to ½ the thickness T. Further, the entrance and exit of the housing is preferably offset from one another. In one specific embodiment, the housing 19 is rectangular in shape, having an L value of 4 inches and a T value of 24 inches (and a width of 18 inches). It is to be understood that the housing, and the placement of the entrance and exit, can be of many shapes and designs in order to maximize the air flow through the desiccant within the housing, and to maximize the rate and amount (efficiency) of water absorption.

Within the air flow pathway in both the washing and drying cycle is a fan and associated motor 35. The fan must be of such a strength that it will create a desirable air flow through the desiccant bed 21. Preferably, a high rate of air flow should be achieved so that a suitable amount of turbulence is created within the desiccant housing. In a smaller washer-drier unit, a fan that generates between about 200–300 cfm can be used, while for a larger, standard residential sized washer-drier unit a fan that generates between about 400–500 cfm should be used.

The desiccant recharging system 13 also includes a primary retort tube 15*a*, a wash cycle retort tube 15*b*, and a drying cycle retort tube 15*c*. Air flow is diverted by diverting valve 17. Thus, in its wash position, the valve 17 allows air to flow through retort tubes 15*b* and 15*a*, while in the drying position valve 17 allows air flow through retort tubes 15*c* and 15*a*. Coupled to this tubing system is air duct 65, which is in turn coupled to the tub 37 through air inlet 27. To complete the air circuit, air outlet 29 within the tub 37 is coupled to the retort tube 15*c*.

The clothing or other articles to be washed and dried are placed within the tub 37 having tumbler 39. A doorway 63 is coupled to the tub 37 to allow closure of the system, air space 12 thus created within the tub. The tumbler 39 may be insulated to increase the efficiency of the heating process. The tub and tumbler therein may be tilted relative to the horizon 30. Thus, a tilt axis 20 may be created relative to the horizon (or level floor) 30 to an angle $\alpha$ of between about 0° and 30°.

The tumbler 39 is operatively coupled to drive shaft 50 and drive wheel 53. The tumbler motor 49 is coupled to the wheel 53 by belt 51. The tumbler motor 49 can be programmed by standard means, either mechanically or electronically, to agitate the clothing within the tumbler with a back and forth motion, or to turn continuously in the same direction when drying.

Water is pumped into the tub through inlet 45 and water makeup valve 43. It is to be understood that for standard residential and commercial usage, both a hot water inlet and a cold water inlet will be required, and means to synchronize the two provided. When the tub is filled with water, the door 63 should make sealing contact with the tub to keep water within the tub from leaking out. The water makeup valve can also be programmed by standard means to purge water into the tub at the appropriate wash times during a wash cycle. The water flows through tub inlet 61. The water can then exit through tub drain 59, the drainage of water controlled by the water pump 41. Water is drained using pump 41 through water outlet 57.

Figure 2:
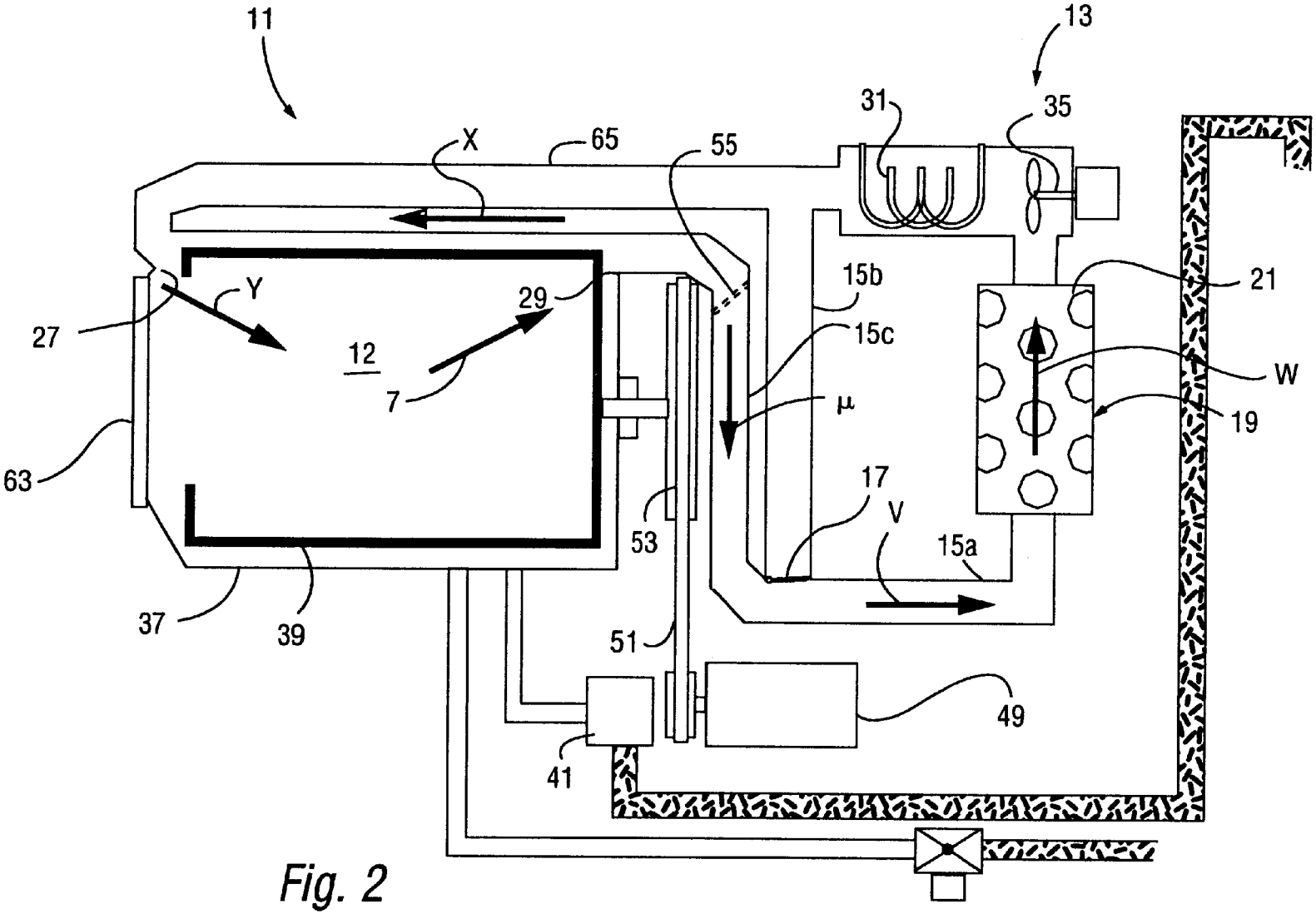
FIG. 2 is a schematic view of the drying cycle of the combination washer-drier of the invention.

The general mode of operation, and hence the air flow pathways, is now described with respect to FIGS. 1 and 2. The apparatus is first installed into a dwelling such as a home, apartment, or other area having a flat, horizontal surface to rest the apparatus upon and having a 110 or 220 volt power supply. Further, a cold and hot water supply and water drain is also necessary. The cold and hot water supplies are then coupled to the apparatus as in standard washer systems. Further, the combination washer-drier is connected to a power supply to supply power to the entire unit. Finally, the water outlet is coupled to a water drain within the dwelling.

In the washing mode of the invention, the apparatus 11 creates a washing cycle air pathway described by arrows A, B, and C. While in the washing mode, the desiccant 21 must be regenerated or dehumidified prior to use in drying the clothing in the tumbler. Thus, in the washing mode as described in FIG. 1, the fan 35 creates an air flow A-B-C through the dehumidifying means 33, then through retort tube 15*b*, then through retort tube 15*a*, then through the desiccant 21, first entering the entrance 23 and exiting at the exit 25. The air is then passed again through the dehumidifying means 33 in a cyclic fashion throughout the washing cycle. The diverting valve 17 is programmed along with the tumbler motor 49 to work in synchrony between the washing cycle and drying cycle.

During the washing cycle, air is passed through the dehumidifying means, preferably heating coils 31, to heat the air. The A-B-C air pathway is heated such that the air leaving the heating coils is steam. This steam-air expanding from the regenerating desiccant as water desorbs. This expanding water-laden air expands through pathway D-E where it condenses. The fan maintains an air flow through the A-B-C pathway during this expansion. The cooled, relatively dry air then passes to path A-B to the desiccant to then facilitate the desorption of water that is adsorbed onto the desiccant. The coils may also be used to heat the housing 19 and hence the desiccant 21 in order to drive off the adsorbed water therein. Preferably, the washing cycle should allow for 20–40 minutes of desiccant recharging time in order to adequately recharge the desiccant material.

During the washing cycle, the washing of the clothing and other articles is carried out within the tumbler 39 and tub 37. The tumbler is programmed by any suitable means to agitate the clothing within while the tub is filled with water to, for example, a level 47. After a washing cycle, the water is preferably drained from the tub and refilled with fresh water to rinse the clothing while the tumbler agitates the clothes. Finally, the rinse water is then drained and the tumbler may then spin rapidly in one direction to flush the clothing and articles of excess water. The clothing is then ready for the drying cycle.

In the drying cycle described with reference to FIG. 2, the diverting valve 17 alters the flow of air to a drier cycle air pathway U-V-W-X-Y-Z. This is a continuous flow of air that utilizes the same or substantially the same volume of air that was used in cycle A-B-C (D-E). A removable lint filter 55 is placed in retort tube 15*c* in the present embodiment to capture any lint from the drying clothing. Initially, the heating coils 31 heat air passed over the coils by fan 35. The air passes through duct 65 to the air inlet 27 into the tub to extract the moisture from the articles within the tumbler. The tumbler may be perforated to allow air to flow through and around the clothing.

The air flow Z, which is moisture laden air, flows out of the tub through air outlet 29 into retort tube 15*c*, where it passes into retort tube 15*a* and then into the desiccant bed 21. The "regenerated" or dehumidified desiccant then adsorbs moisture from the air flow U-V-W. The air then is heated in part by heating coils 31 and in part by the exothermic heat of absorption from the desiccant bed to for a dry air flow X. The cycle is repeated for 15 to 40 minutes to completely dry the clothing.

In the above described embodiment of the washer-drier system, the regeneration and drying times can be affected by altering the power of the fan and heater. For example, in a relatively small unit that washes and dries 6 bath towels using silica gel desiccant, a 110 volt fan (1.5 Amp, about 150 cfm) and 110 volt heater can dry the towels in about 45 minutes, while regeneration takes about 35 minutes when the heater heats the desiccant to between about 250–300° F. When a 110 volt fan of 3.5 amps is used that circulates the air at about 250 cfm with the same heater, the dry time is reduced to 25 min and the regeneration time to 35 min. When the heater is then increased in power to 240 watts (220 volts, 11 Amps), the drying time for the 6 towels is 10–15 min and regeneration time is 35 min. In the later case, a power cut-off for the heater is set at 300° F. so as to prevent overheating.

Figure 3:
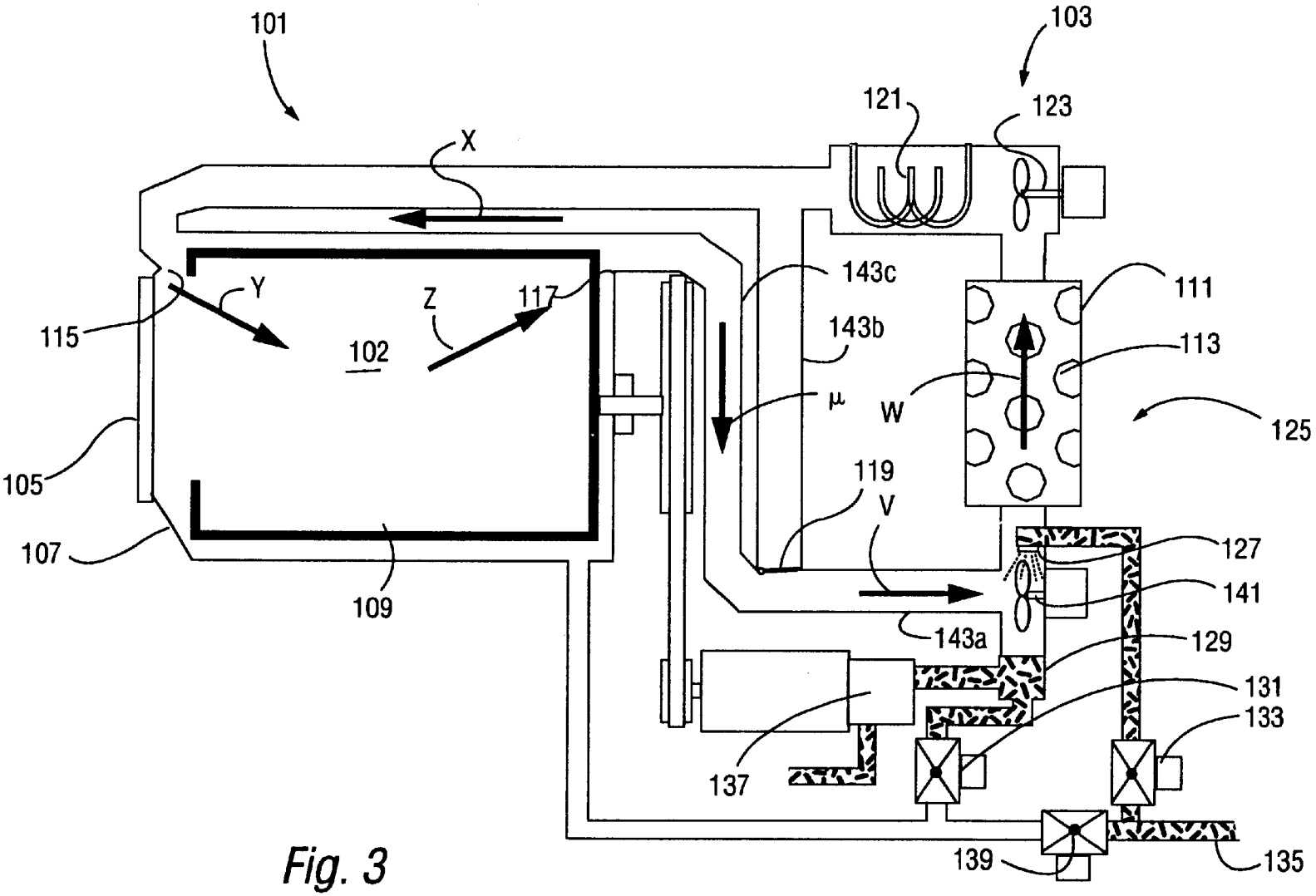
FIG. 3 is another embodiment of the combination washer-drier of the invention.

Another embodiment of the invention is described with respect to FIG. 3, wherein the drying and washing of the clothing is facilitated with a misting sprayer apparatus 125 coupled to the combination washer-drier apparatus 101. The apparatus 101 includes a desiccant recharging system 103, a tub 107 having a tumbler 109 and airspace 102, and doorway 105. Within the tub is air inlet 115 and air outlet 117. Further, the desiccant recharging system 103 includes heating coils 121, desiccant housing 111, desiccant 113, and a fan with an associated motor 123. Air flow is maintained by the fan through retort tubes 143*a*, 143*b*, and 143*c*, the diverting valve 119 used to divert the flow of air between the washing and drying cycles.

The spray mist apparatus 125 includes a spray nozzle 127 coupled to a misting valve inlet to allow water to flow through the nozzle in synchrony with the cycle of the apparatus 101. Fan and associated motor 141 is used to facilitate the movement of the air through the air flow pathways, and is optional. The water catch 129 catches the condensed water that comes from the heated, moisture laden air within the tub of drying clothing. Water pump 137 drains away the water, and drain valve 131 drains excess water from the catch 129. Water is supplied from the inlet 135 to the water makeup valve 139 and to the mister control valve 133. Use of the spray mist apparatus is shown in the drying cycle in FIG. 3, wherein drying cycle air flow U-V-W-X-Y-Z is made to flow through the apparatus 101, the heated dry air flow X flowing into the tub of wet clothing, and the moisture laden air flow Z passing from the tub to flow U. Flow U turns to flow V, which passes the heated, moisture laden air through the mister 127, which sprays a fine, cool mist of water into the air pathway. This causes excess moisture to condense from the pathway as it flows into the desiccant in flow W, the desiccant then adsorbing the excess moisture from the air flow. The cycle is then repeated for 15–40 minutes while clothing is continuously turned within the tumbler, or until the clothing is dry.

During the washing cycle, the desiccant is being dehumidified or regenerated. The recharging cycle removes water adsorbed into the solid phase desiccant, preparing it for adsorbing water in the drying mode of operation. The bed of desiccant is regenerated by the use of a thermal swing. The thermal swing involves heating the bed to a temperature at which the adsorptive capacity for water is reduced to a low level so the adsorbate, water, leaves the surface and is easily removed by a small stream of purge air. The heating is normally done with this purge air at operating pressure generated within the air flow pathways by the fan 35 (and fan 141 in another embodiment).

When a thermal swing regeneration is used as in the present invention, the temperature required to desorb the adsorbed water is determined primarily by the type of adsorbate to be removed, the type of adsorbent, and the nature of any co-adsorbed contaminants. Naturally, the regeneration conditions control the effluent dewpoint during the next adsorption cycle. Normally, the effluent dew point can be improved by an increase in temperature, a decrease in pressure, a decrease in water content in the regeneration gas, and a longer heating time.

For example, typical molecular sieves require a regeneration temperature range of between 375° F. and 600° F., while silica gel requires a range from about 200° F. to 400° F. This temperature is necessary to overcome the energy required to desorb an adsorbate. For example, at least 1800 btu are required to remove one pound of water from a typical molecular sieve. This includes the heat for the phase change to vapor and the adsorption bond breakage or heat of wetting. This energy corresponds to the heat released when water binds to molecular sieves. R. E. Trent, *Fundamentals of Adsorption,* 10 (Feb. 26, 1995).

As water is released from the desiccant into the hot air, it is in the form of steam. This release of steam from the desiccant increases the volume of air and steam that is in the air flow pathway C through the desiccant. This increase in volume expands through the air duct 65 and into the tub. Because the temperature of the tub is maintained at a temperature much lower than steam by the wash and rinse water, the steam is condensed into the liquid state and collects in the wash and rinse water. This reduced air volume in the tub area 12 caused by condensation pulls more steam through pathway D-E. In this manner, the air within the apparatus air flow pathways is dehumidified, and more importantly, can then be used to further dehumidify the desiccant 21.

Thus, one advantage of the present invention is the capacity of drying clothing with air that is relatively cool and dehumidified relative to the prior art since the air is first dried in a solid desiccant, thus more efficiently drying the clothing once intimate contact is made between the dry air and the wet clothing in the drying cycle. The drying time is also decreased by the increased air flow capabilities of the present invention in relation to prior art ventless washer-drier combination apparatuses.

Another advantage to the present invention is that the same or substantially the same volume of air is used throughout the drying process. This eliminates the need for a vent to vent the moist, heated air out of the dwelling of the user. This also has the advantage of being economical since the surrounding air conditioned or heated air is not pulled into the apparatus to dry the clothing or dehumidify the desiccant, thus necessitating more energy consumption by the dwelling furnace or air conditioner unit.

Another advantage of the present invention is that an increased air flow is provided in the drying cycle pathway to improve the drying time for the clothing. This also improves the dehumidification efficiency of the desiccant.

Yet another advantage to the present invention is that space is economized within the dwelling in which the is used. Typically, separate washer and drier units can take up as much as 70–75 cubic feet of space, while the present invention may take up only half the space. This is especially advantageous in small dwellings such as apartments or condominiums.

While the invention has been shown in only one of its forms, it is not thus limited but is susceptible to various changes and modifications without departing from the spirit thereof.

What is claimed is:

1. A ventless combination closed-circuit washer and drier apparatus having a washing cycle and a drying cycle for a load of laundry, the apparatus comprising:

a unitary washer housing having an insulated tub and a tumbler within the tub, the tub also having an air inlet and air outlet which allows air to flow through the tub, wherein air flowing from the air inlet is in communication with the tumbler;

a desiccant housing containing a solid desiccant, the desiccant housing being located within the unitary washer housing and having an entrance and an exit, the entrance coupled to the air outlet and the exit coupled to the air inlet, thus allowing a continuous flow of internal air through the tub and desiccant housing in a closed air flow circuit;

desiccant recharging means for providing a reversible removal of water adsorbed onto the desiccant using only internal air in the closed air flow circuit so that substantially the same volume of air is used throughout the washing cycle and the drying cycle for one load of laundry.

2. The apparatus of claim 1, wherein the desiccant recharging means also includes a diverting valve that directs the flow of air primarily through the desiccant housing in a closed-loop during the wash cycle.

3. The apparatus of claim 1, wherein the tub is placed in the housing at an angle of between about 0° to 30° relative to the horizon, the tumbler being at an angle equal to that of the tub.

4. The apparatus of claim 1, wherein the desiccant recharging means has a solid desiccant packed within a desiccant housing.

5. The apparatus of claim 4, wherein the desiccant is silica gel particles.

6. The apparatus of claim 4, wherein the desiccant is molecular sieves of a pore diameter of between about 3 and 5 Angstroms.

7. The apparatus of claim 4, wherein the desiccant housing has a thickness that is at least twice as long as the length.

8. The apparatus of claim 1, wherein the desiccant recharging means includes a dehumidification means.

9. The apparatus of claim 8, wherein the dehumidification means is a heating coil.

10. The apparatus of claim 8, wherein the dehumidification means is a microwave generator.

11. The apparatus of claim 1, wherein the desiccant recharging means has a water mist spray apparatus to facilitate the removal of water from the air flow during the washing and drying cycles.

12. The apparatus of claim 1, wherein the tumbler is programmed to turn continuously in one direction during the drying cycle.

* * * * *